United States Patent [19]

Pohl

[11] Patent Number: 4,558,919

[45] Date of Patent: Dec. 17, 1985

[54] MULTIPLE ELECTRICAL CONNECTOR AND BLOCK HAVING A BACK TO BACK CONFIGURATION

[75] Inventor: Karl-Heinz Pohl, Buffalo, Minn.

[73] Assignee: The Siemon Company, Watertown, Conn.

[21] Appl. No.: 537,067

[22] Filed: Sep. 29, 1983

[51] Int. Cl.[4] ..... H01R 13/50

[52] U.S. Cl. ..... 339/206 R; 339/97 R; 339/156 R; 339/198 S

[58] Field of Search ..... 339/97 R, 97 P, 98, 339/99 R, 198 R, 198 S, 206 R, 206 P, 210 R, 210 M, 154 A, 156 R, 154 R, 154 L, 155 R, 155 L, 155 T, 156 T

[56] References Cited

U.S. PATENT DOCUMENTS

| | | | |
|---|---|---|---|
| 3,112,147 | 11/1963 | Pferd et al. | 339/198 R |
| 3,132,913 | 5/1964 | Pohl | 339/97 P |
| 4,363,530 | 12/1982 | Verhoeven | 339/156 R |
| 4,381,880 | 5/1983 | Pohl | 339/210 M |
| 4,408,391 | 10/1983 | Pohl | 29/861 |
| 4,408,820 | 10/1983 | Eaby et al. | 339/156 R |
| 4,425,019 | 1/1984 | Pohl | 339/97 R |
| 4,462,656 | 7/1984 | Beyer | 339/154 A |

*Primary Examiner*—Gil Weidenfeld
*Assistant Examiner*—Gary F. Paumen
*Attorney, Agent, or Firm*—Fishman & Dionne

[57] ABSTRACT

Multiple electrical solderless connectors inserted into suitable mounting blocks are arranged in a back to back configuration wherein two blocks are mechanically attached to opposite sides of a retainer. The solderless connectors are electrically interconnected via conductive connecting pins which frictionally engage the retainer and are held tightly by a recess in one of the mounting blocks.

16 Claims, 4 Drawing Figures

MULTIPLE ELECTRICAL CONNECTOR AND BLOCK HAVING A BACK TO BACK CONFIGURATION

BACKGROUND OF THE INVENTION

This invention relates to the field of multiple electrical connectors and mounting blocks therefor. More particularly, this invention relates to a new and improved mounting block for wire formed solderless multiple connectors of the type shown in my prior U.S. Pat. No. 4,381,880 and having a novel back to back configuration.

My earlier U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in my prior U.S. Pat. No. 3,132,913 was intended as an improvement on and had several advantages over prior art clip type connectors of the type generally shown in U.S. Pat. No. 3,112,147 (of which I am coinventor) and which are sometimes referred to in the art as "66 Type" connectors.

My subsequent U.S. Pat. No. 4,381,880 is an improvement over deficiencies in U.S. Pat. No. 3,132,912. U.S. Pat. No. 4,381,880 relates to a mounting block for solderless connectors having a retainer and a body section which defines slots for housing terminal defining conductive elements. These conductive elements are formed from wire to define linearly aligned plural loops between which wires may be inserted. The conductive elements are arranged in uniformly spaced horizontal rows and vertical columns of terminals.

It has occurred to me that it may be advantageous to interconnect a mounting block as described in U.S. Pat. No. 4,381,880 with two or more similar mounting blocks. Unfortunately, means for electrically and mechanically connecting two or more such mounting blocks are unavailable and heretofore unknown. This severely reduces the number of possible mounting block interconnecting arrangements and configurations.

SUMMARY OF THE PRESENT INVENTION

The above discussed and other problems of the prior art are overcome by the apparatus for interconnecting two or more mounting blocks for multiple electrical connectors of the present invention. In accordance with the present invention, a connecting retainer is provided which effects a snap action mechanical connection between two individual mounting blocks for wire formed solderless multiple connectors. The connectors are then electrically interconnected via a metal connecting pin. This pin is mounted through an aperture in the retainer, so as to protrude outward on either side. When the mounting blocks are then snapped onto the respective sides of the connecting retainer, the protruding ends of the connector pin come into electrical and mechanical contact between the bottom loops of the respective multiple solderless connectors. The arrangement of mounting blocks on either side of a retainer as described above defines a back to back configuration.

As mentioned, this novel back to back arrangement of mounting blocks electrically interconnected via connector pins comprises a pair of mounting blocks and electrical connectors which are very similar to that described in U.S. Pat. No. 4,381,880, which is assigned to the assignee hereof and incorporated herein by reference. More accurately, the multiple terminal solderless electrical connector is formed from a length of wire. The wire is alternately looped to form two oppositely facing rows of loops. A first row of loops is formed with relatively straight parallel sides, while the second row of loops, which interconnect the loops of the first row, is formed with inwardly converging sides. The loops of the first row are configured so that the straight side portions of adjacent loops are in intimate contact to form an individual connector. The loops in the second row are spatially separated from each other.

Each mounting block is provided with slots for receiving the wire connectors. The dimensions of the slots are such so that the wire connectors are prevented from lateral movement and constrained from any type of displacement. The connectors are positioned within the mounting blocks so that the first row of loops is exposed for receiving wire conductors. As discussed above, the mounting blocks are further provided with a plate for both retaining the connectors as well as connecting two blocks. This plate supports a plurality of connector pins that are positioned to be engaged between the spatially separated loops of the second row of connectors in each block. The gap between the loops is such so that a firm engagement with the connector pins is effected.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
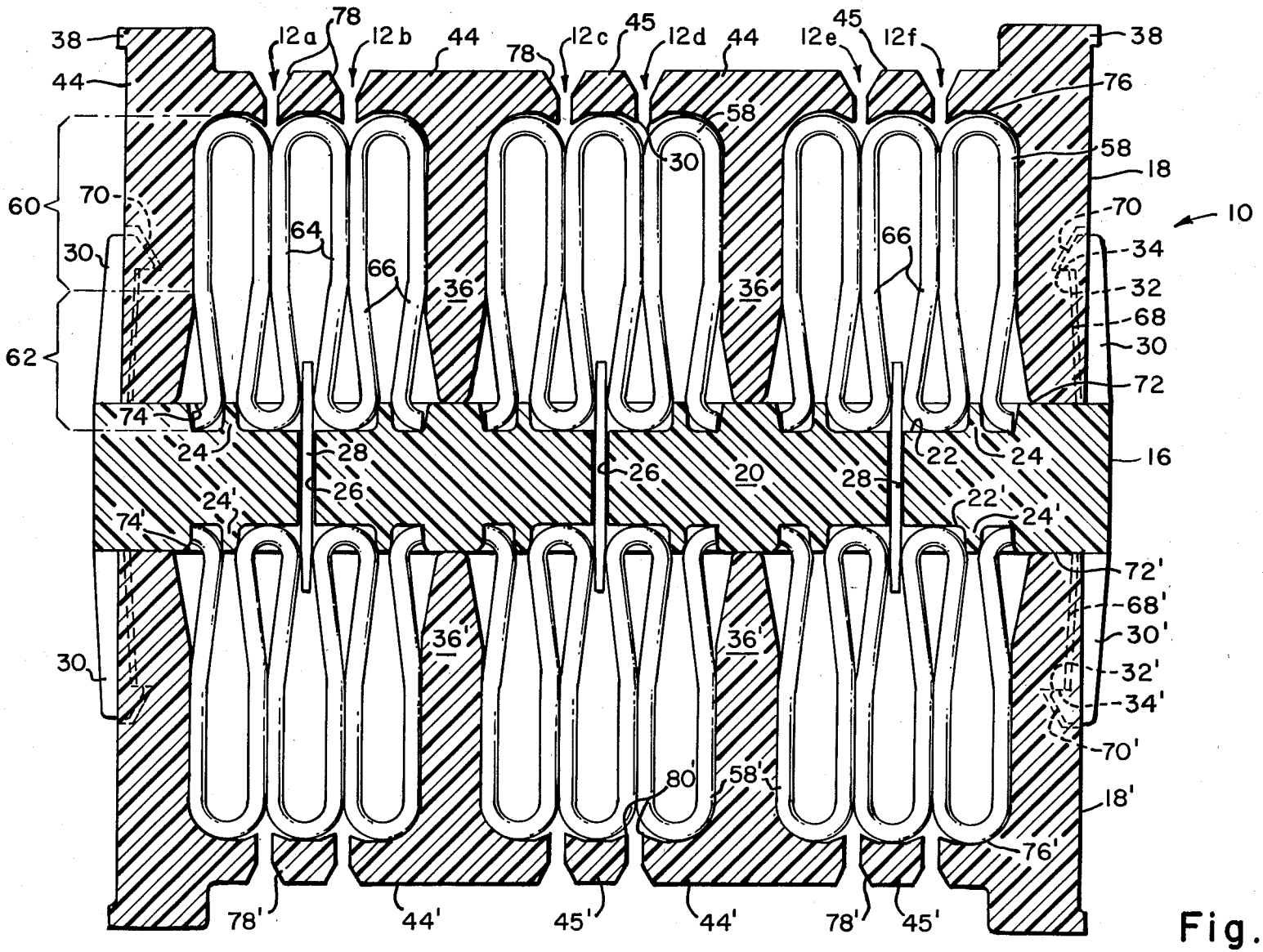
FIG. 1 is a cross-sectional side elevation view of the three portions of a back to back connector block in assembled form in accordance with the present invention.
Figure 2:
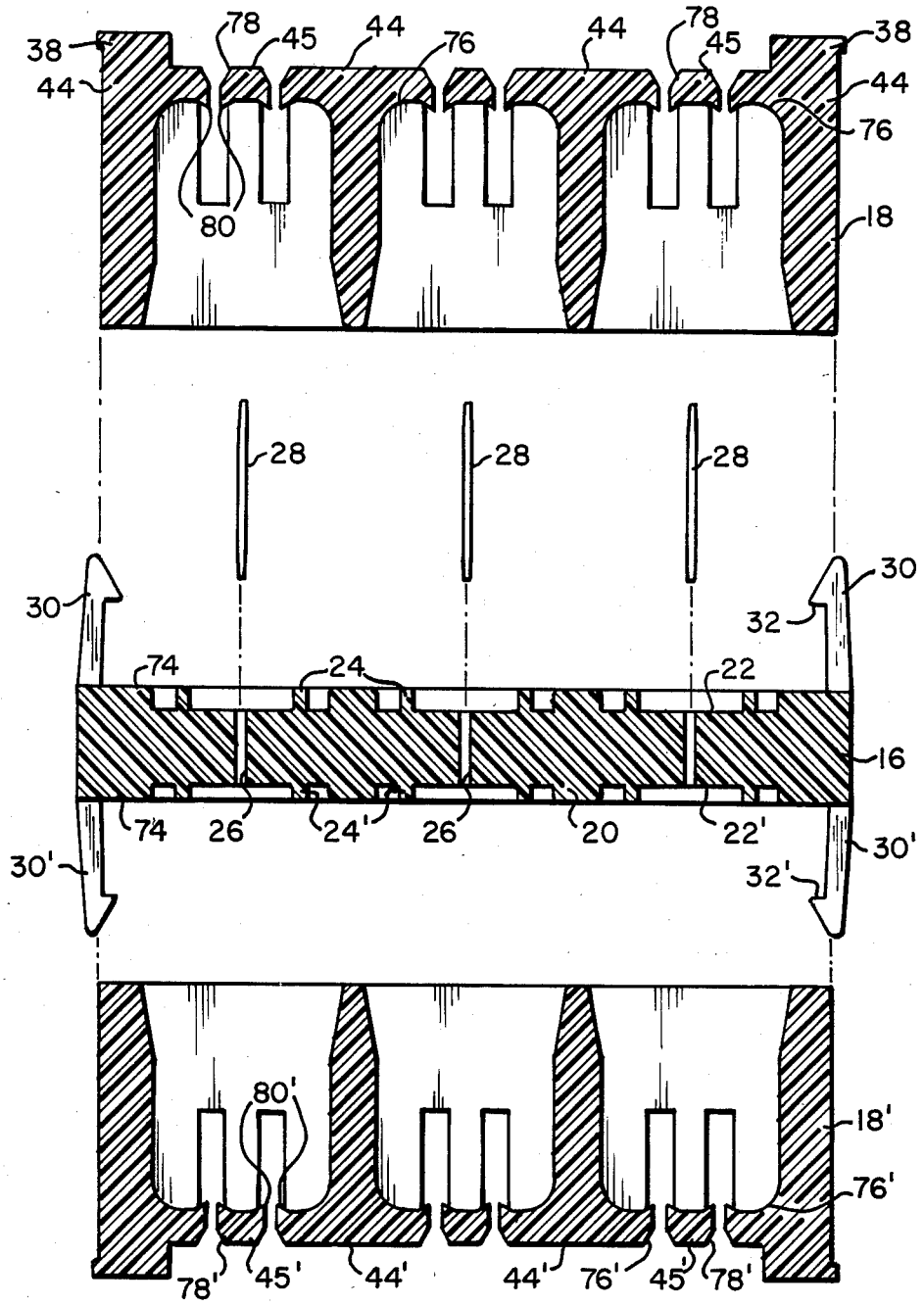
FIG. 2 is an exploded view of the mounting blocks and retainer of FIG. 1 in accordance with the present invention.

FIGS. 1 and 2 show a block, generally indicated at 10, for 24 connector locations, arranged in a six by six array. That is, front to back of the block there are six columns of connector locations, each of which has six rows from side to side. While the details which make up these six columns and six rows will be discussed in more detail hereinafter, the six columns are generally indicated at 12(*a*) through 12(*f*) in FIG. 2, and the six rows are generally indicated at 14(*a*) through 14(*f*) in FIG. 3. Of course, it will be understood that any desired number of rows and columns can be used, and the six by six array is merely for purposes of illustration.

Block 10 is comprised of three basic interlocking parts. These three parts are a connecting retainer 16 and a pair of main body units 18, 18' all of which are molded plastic elements. For purposes of clarity and understanding, retainer 16 and main body units 18, 18' are separately shown in the exploded view of FIG. 2. FIG. 2 thus depicts separate non-conductive parts of the assembled unit shown in FIGS. 1, 3 and 4. Retainer 16 has a base portion 20 with a series of latitudinal (side to side) interrupted slots 22, 22' therein corresponding to the number of rows of conductive connector elements to be housed in the block. Retainer 16 is also provided with a series of upstanding spacer members 24, 24' which are integral with retainer 16 and extend upwardly and downwardly from the face of the slots 22, 22'. The spacers 24, 24', which constitute interruptions in slots 22, 22', are arranged in a predetermined pattern and are aligned with the outer bridges 44, 44' of main body units 18, 18'. In those areas of the slots 22, 22' in retainer 16 which will be in alignment with outer bridges 44, 44' in body units 18, 18' when the retainer and body unit are assembled, and where a spacer 24, 24' has not been formed, an aperture 26 is provided through the base 20 of retainer 16, the apertures 26 thus communicating with the interrupted slots 22, 22'. These apertures 26 are generally in alignment with a center bridge 45, 45'. A conductive connector pin 28 is press fit into each of apertures 26. Pins 28 will typically extend out of slots 22, i.e., the pins will terminate above the "floor" 74 defined in part by the tops of spacers 24.

Figure 3:
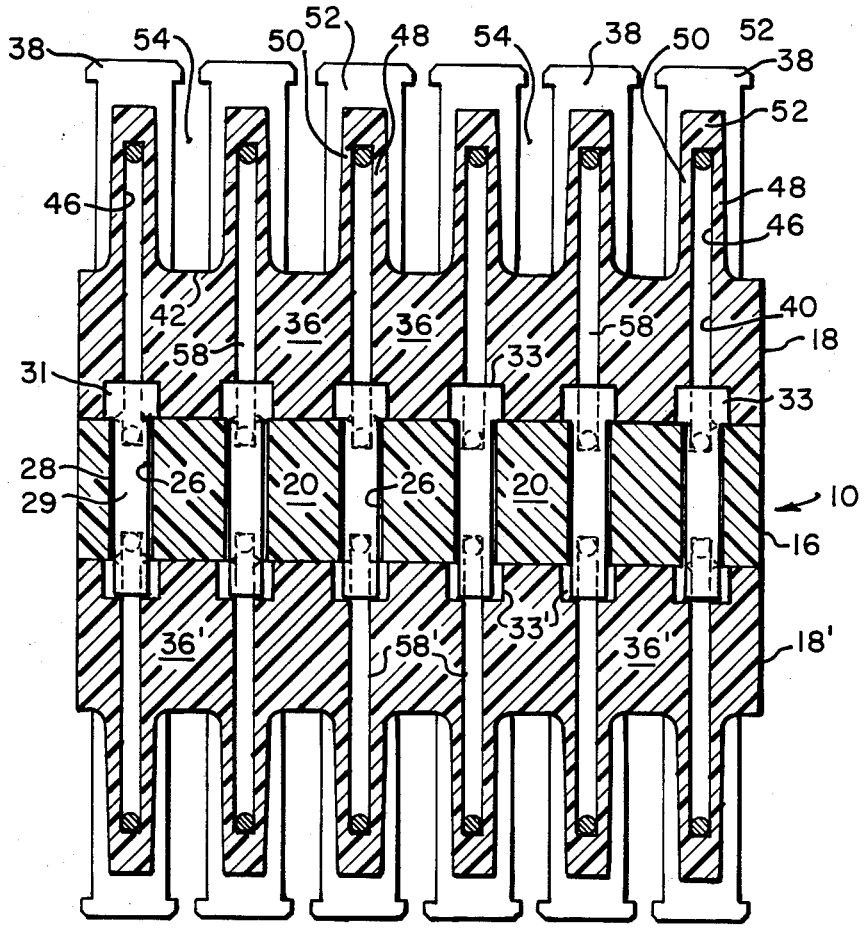
FIG. 3 is a sectional view along the line 3—3 of FIG. 1 in accordance with the present invention.

Connector pins 28 are comprised of an electrically conductive material having a rod-shaped base 29 of rectangular or circular cross section and a rectangular head portion 31 as shown in FIG. 3. Main body unit 18 is preferably provided with a recess 33 between the lower portion of solderless connector loops which acts to receive and hold the preferably rectangular head portion 31 of pin 28 after retainer 16 has been snapped into place. This recess 33 may be integrally molded in the body portion 36 of main body unit 18. Note that main body unit 18' also has a recess 33' which is capable of accepting the head portion 31 of pin 28 if the pin is oriented in the opposite direction than is shown in the FIGURES. Thus, main body units 18, 18' are identical in structure, therefore providing ease of manufacture as well as low cost construction. While FIGS. 1 and 2 illustrate only three apertures 26 and three conductive connector pins 28 positioned in slots 22, 22', it is to be noted that any arrangement is possible depending upon the desired end use. As will be discussed below, the base portion 29 of each pin 28 disposed within slot 22' is frictionally engaged by and in electrical contact with a connector element. The head portion 31 of each pin 28 is snuggly retained by recess 33 and retainer 16 and in electrical contact with the corresponding connector element in slot 22. Of course, any suitable geometric pin configuration will work adequately in electrically interconnecting the two main body sections 18, 18'.

Retainer 16 also has a plurality of locking arms 30, 30' which extend upwardly and downwardly, respectively, from base 20 along each side of the retainer. Locking arms 30, 30' are slightly resilient and springy, so that they can be deflected outwardly and then spring or snap back into place to lock retainer 16 to main body unit 18, 18' together. The upper part of each locking arm 30, 30' has an inwardly projecting locking surface or shoulder 32, 32' which engages a corresponding locking surface or shoulder 34, 34' on main body units 18, 18'.

Figure 4:
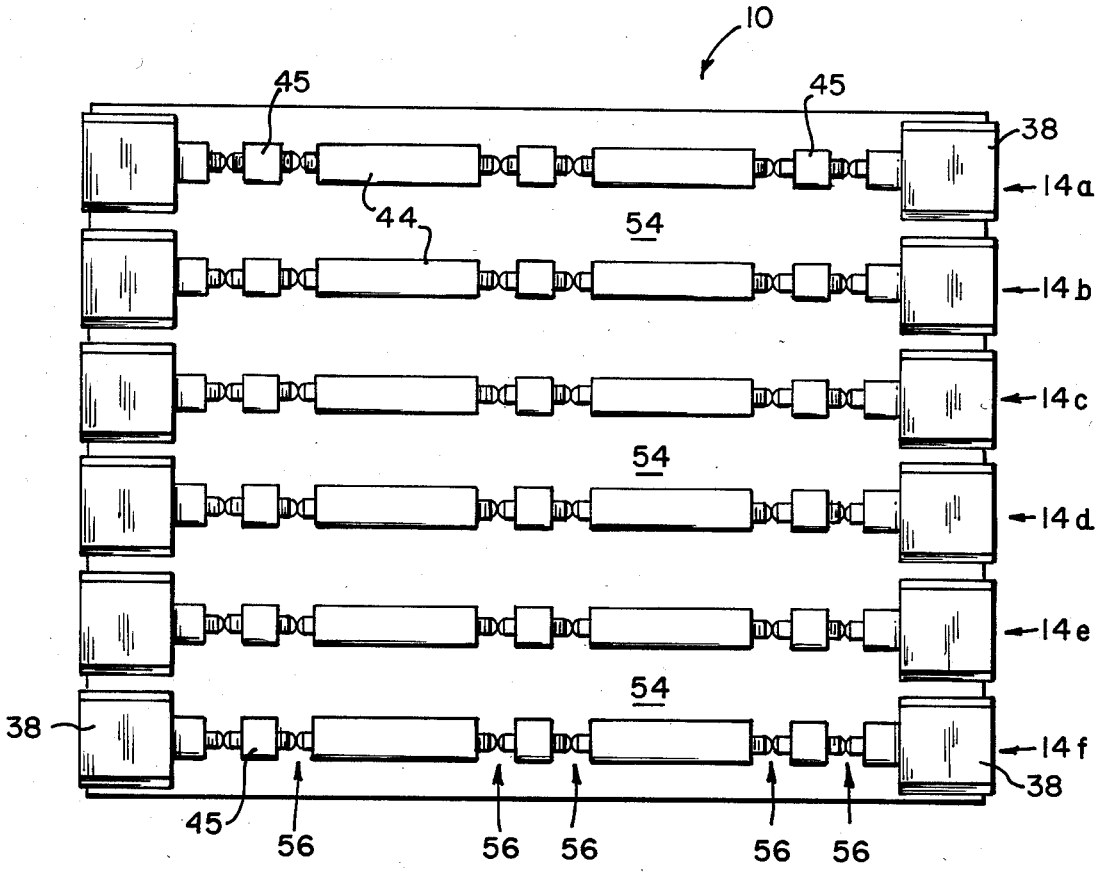
FIG. 4 is a top plan view of the connector block of FIG. 1 in accordance with the present invention.

For simplicity, main body units 18, 18' will now be described in detail with reference only to the upper main body unit 18. It should be clear that lower main body unit 18' is identical to upper main body unit 18 as previously pointed out. Referring now to FIGS. 1, 2 and 3, main body unit 18, has a main body portion 36 with two fanning strips, defined by posts 38, running along each side. The fanning strips serve as a means of orderly entry into the block for the insulated conductors of a communications cable or system which are to be electrically connected to solderless connectors in the block. Main body unit 18 includes, in body portion 36, a plurality of longitudinal slots 40 (as seen in FIG. 3) which correspond to and are in alignment with each of the longitudinal slots 22 in base 20 of retainer 16. Body unit 18 has an internal floor or surface area 42 from which a series of inverted U-shaped bridges 44, which are integrally molded parts of main body unit 18, project. In a preferred embodiment, the bridges are arranged in groups of three. Each group has two outer bridges 44 and one center bridge 45. In the particular embodiment shown in the FIGURES, three groups of bridges, each housing a solderless connector element therein are located in side-to-side rows. Note that the outer bridges 44, which line the perimeter of main body unit 18 are integral with posts 38 of the fanning strips. Each outer bridge 44 and center bridge 45 has a passage or opening 46 in alignment with the slots 22 and 40. As will be described in more detail hereinafter, the slots 22 and 40 and the passages 46 serve to house and position rows of wire formed solderless connectors. In the embodiment shown in the drawings, there are six separated rows of the aligned slots 22 and 40. As discussed, each row is divided and spaced in order to accept three individual electrical connector elements. Each bridge 44 or 45 can be considered to be made up of a pair of uprights 48 and 50, joined together by a cross piece 52, which define the passages 46. It will, of course, be understood that all of the bridges 44 or 45 are of similar construction, so only illustrative ones are marked in the drawings. As best shown in FIG. 4, the bridges are spaced apart to define open rows 54 in which to run wires from the fanning strips. As may be seen from FIG. 4, the brides 44 are also spaced to define columns 56 through which access is had to connect the conductors of wires to the connector elements housed in the block.

With reference to FIG. 1, wire formed solderless connectors are indicated generally at 58, 58'. Connectors 58, 58' are formed from any suitable electrically conductive wire stock having sufficient resiliency. As before, the identical connectors 58, 58' will be described only in terms of connector 58. The wire stock is bent to form two coplanar opposite facing rows of loops 60 and 62, respectively. The loops of upper row 60 are formed with straight parallel sides 64, while the loops of lower row 62 are formed with inwardly converging sides 66. The radius of the curved portion of lower loops 62 is less than that of the curved portion which connects the straight sides of the upper loops 60. The straight parallel sides 64 adjacent to the upper loops 60 are in contact and define therebetween individual connectors (two individual connectors per solderless connector element in this particular embodiment). In use, an insulated wire conductor, not shown, is inserted between two adjacent sides 64. As the wire is forced downwardly between two adjacent loops in row 60, any insulation is sheared away at the contact point between the upper loop sections. This shearing action is partly a result of the dimensioning of passages 46 which retains the connectors against lateral movement. This shearing action is diminished as the conductor is forced between the sides 64, since these sides 64 are allowed to bow outwardly. Restated, the multiple terminal connectors 58 function as end-supported beams.

The loops in row 62 are spatially separated from each other to allow the positioning of spacers 24 or connector pins 28 between them. This spatial separation is selected to allow the loops to firmly grasp the connector pins 28 and maintain a good electrical connection thereto. The spacers 24 and pins 26 are sized and shaped so as to preclude relative movement between loops 62 after the connecter block has been assembled. Note that the recess 33 in main body unit 18 will act to further hold the pin from any longitudinal or lateral movement once the retainer 16 has been engaged.

In assembling a block in accordance with the back to back configuration of the present invention, the wire formed solderless connectors 58, 58', such row type connectors being clearly seen in FIG. 1, are loaded into the slots 40, 40' and bridge passages 46, 46' of main body units 18, 18'. Next, connector pins which will electrically interconnect main body unit 18' are frictionally fit into desired apertures 26 in retainer 16 and slid down through until head portion 31 is stopped or retained by the retainer 16. While a pin 28 preferably has a head portion as described above, a simple straight connecting pin could also be employed. A straight pin should preferably be press fit into the retainer 16, being engaged therein by strong frictional forces. Retainer 16 is then placed in position relative to the main body units 18, 18', with the slots 22, 22' in alignment with the connectors 58, 58', and the retainer and main body units are then moved together to come into locking engagement. As can best be seen in FIGS. 1 and 2, the innermost extension of shoulder 32, 32' on the locking arms 30, 30' overlaps main body surfaces 68, 68' over which the arms must slide in assembling the unit. Thus, when assembling the unit, the inclined surfaces 70, 70' on arms 30, 30' will be engaged by surfaces 68, 68', whereby the locking arms 30, 30' are cammed and deflected outwardly as retainer 16 and main body units 18, 18' are moved together. When the retainer and main body unit have been positioned so that the bottom 72, 72' of body portion 36, 36' is adjacent to the floor 74, 74' of retainer body 20, the locking arms snap inwardly with locking shoulder 32, 32' overlapping cooperating shoulder 34, 34' to complete the assembly of the block. In this manner, the wire formed connector strips are locked and retained in place in the block and are ready to receive single or plural, insulated or bare, single conductor or stranded wires to be mounted thereon. During this assembly procedure, the pins 28 and the spacers 24 will be forced between lower loops 62 of the connector element 58. Also, the head portion of each pin 28 will be received and housed by each respective recess 33 in main body unit 18.

With particular attention to FIGS. 2 and 4, it can be seen that each row of three wire connector elements 58, 58' are fully retained against movement or deflection toward any adjacent row, since the lower loops of each wire connector element are fully captured in a slot 22, 22' and the connector elements are also captured in slots 40, 40' and the bridge passages 46, 46' in the outer bridges 44, 44' and center bridges 45, 45'. Thus, each wire connector row is fully constrained against displacement which would create misalignment and interfere with the insertion of wires. Also, the bridges 44, 44' and 45, 45', especially cross pieces 52, 52', shield the wire connectors and prevent short circuiting by outside objects which might fall into or otherwise come into contact with the top of the block, this protection being realized without the need for a separate cover on the block.

Each row of wire-formed connectors is not only retained against deflection toward an adjacent row, but also resists lateral deflection of each connector row when a conductor is inserted therebetween. As clearly seen in FIG. 3, each wire-formed multiple connector 58, 58' is snuggly captured within slots 40, 40' of main body 18, 18' and passages 46, 46' of U-shaped bridges 44, 44' and 45, 45'. The upper loops at each end of each connector are retained against outward movement by the upper side walls 76, 76' of the outermost bridges 44, 44'. Each loop of each connector wire is also prevented from overlapping the adjacent loops by the uprights 48, 48' and 50, 50' of bridges 44 and thus the bridges function to stiffen the upper loops of the connectors.

The upper loops or portions of the wire-formed connectors 58, 58' within the blocks 10 are also retained and stiffened. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend. The application of a force which is initially high and which decreases in the direction of wire insertion is completely contrary to prior art practice.

Another feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention, there will be no outward expansion of the upper loop portions which would diminish their insulation stripping function. Also, the connector blocks will reliably receive and retain multiple electrical conductors at each connector location.

Referring now to FIGS. 1 and 2, wings or projections 78, 78' are located at the top part of each bridge 44, 44' and 45, 45'. These wings 78, 78' extend between and toward adjacent bridges within a row, so that they narrow the gap between adjacent bridges within each row. The tops of adjacent wings 78, 78' on adjacent outer bridges 44, 44' and center bridges 45, 45' are inclined to define a lead in area or ramp to guide an electric wire into position for insertion in the connector block and electrical and mechanical attachment to the wire formed in the block. As can also be seen in FIGS. 1 and 2, each wing 78, 78' terminates in a downwardly pointed end surface 80, 80' which serves as a retention mechanism to hold the electrical wire in place in anticipation of connection to the wire formed connector strip. This retention mechanism is effected due to the fact that the insulation covering on a wire conductor is slightly compressed as it passes through the opening defined by the wings 78, 78' between adjacent outer bridges 44, 44' and center bridges 45, 45', and the pointed ends 80 frictionally engage and retain the outer insulation of the wire. The winged extensions 78, 78' of the bridges serve both to provide lead ins for the wires and retain the wires in place in anticipation of connection to the connectors in the block. The wires to be connected to the block will, typically, be lead into the block through the open rows 54 between adjacent posts 38, 38' of the fanning strips, and the wires will then be laid into the position discussed immediately above with respect to FIG. 1 in anticipation of eventual connection to the wire-formed connector strip 58, 58'.

The actual mechanical and electrical connection of conductor wire to the wire connector 58, 58' will, typically, be effected by means of a wire insertion tool somewhat similar to the general type presently used for inserting wires into "66 Type" connectors of the type shown in U.S. Pat. No. 3,132,913. A tool designed for use with the connector block of the present invention is disclosed in my co-pending application Ser. No. 233,983, now U.S. Pat. No. 4,408,391, filed Feb. 12, 1981 and assigned to the assignee of the present invention. Mechanical and electrical connection of a wire conductor to the connector 58, 58' is effected by forcing the wire downwardly between adjacent loops of wire connector 58, 58'. The wire conductor will typically be forced down to floor 42, 42'. As this happens, as described above, the insulation is sheared and adjacent straight sections of the loops of the connector are subsequently urged apart, and generate strong spring return forces, so that firm physical and electrical contact is established between the wire core of the electrical conductor and the adjacent loop surfaces of the wire connector 58, 58'.

The apparatus for mechanically and electrically interconnecting two or more mounting blocks (back to back) of the present invention permits greater versatility in designing specific circuits and overcoming special and other constraints when using multiple solderless connectors. The need for a plurality of connector configurations is especially important in the telephonic art where connections can become very complicated and design flexibility is at a premium.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A block for housing electrically conductive wire-formed connector elements of the type having oppositely facing and interconnected upper and lower rows of loops, the block including:

a connecting retainer section, said retainer section having opposite first and second surfaces;

a plurality of rows of spaced slots in said retainer section first surface and a corresponding plurality of rows of spaced slots in said retainer section second surface;

at least some of said spaced slots on said opposite surfaces of said retainer section being provided with apertures and spacers, said apertures and said spacers each being positioned so as to be equidistant from the centers of an adjacent pair of loops of a connector element, said apertures communicating with said retainer section second surface, each of said spacers being a protrusion which will be positioned between and in contact with two adjacent lower loops of one of said connector elements;

at least one elongated electrically conductive pin means, said pin means being positioned and retained within said apertures of said spaced slots, portions of said pin means extending outwardly beyond both of said first and second surfaces of said retainer section, said portion of said pin means extending from said first surface of said connecting retainer section adapted for positioning between and in electrical contact with two adjacent lower loops of a first one of said electrically conductive wire connector elements, said portion of said pin means extending from said second surface of said connecting retainer section adapted for positioning between and in electrical contact the two adjacent lower loops of a second one of said electrically conductive wire connector elements;

a pair of main body sections;

one of said main body sections being adapted to retain at least a first one of said connector elements and the other of said main body sections being adapted to retain at least a second one of said connector elements; and means for releasably joining said pair of main body sections together to said opposite first and second surfaces of said connecting retainer section.

2. A block as in claim 1 including:

a plurality of rows of spaced slots in each of said main body sections in alignment with corresponding rows of slots in said connecting retainer section;

a plurality of bridge elements of each of said main body sections in bridging alignment with the slots in each row of said main body sections, each bridge element defining a passage in alignment with corresponding slots in its respective main body section and the retainer section;

said corresponding retainer slots, main body slots and bidge passages in each main body section cooperating to define housings for a first and second electrically conductive wire connector element; and said bridge elements in each row being spaced apart and in alignment with the bridge elements in other rows to define spaced columns for connection of electrical conductors to wire connector elements.

3. A block as in claim 2 wherein:

said main body section has a floor spaced from said retainer section; and said bridge elements extend from said floor away from said retainer section.

4. A block as in claim 3 wherein:

each of said bridge elements is an inverted U-shaped element integrally molded with the block and having uprights joined together by a cross piece.

5. A block as in claim 2 wherein:

each of said bridge elements is an inverted U-shaped element integrally molded with the block and having uprights joined together by a cross piece.

6. A block as in claim 2 wherein:

bridge elements in each row have projections at the top thereof extending toward adjacent bridge elements in the row.

7. A block as in claim 6 wherein:

said projections on adjacent bridge elements cooperate to define a lead in area for insertion of an electrical conductor.

8. A block as in claim 7 wherein:

said projections on adjacent bridge elements cooperate to define retaining means to retain an electrical conductor therebetween prior to connection to one of said conductive wire formed connector elements.

9. A block as in claim 6 wherein:

said projections on adjacent bridge elements cooperate to define retaining means to retain an electrical conductor therebetween prior to connection to one of said conductive wire formed connector elements.

10. A block as in claim 6 wherein:

adjacent projections on adjacent bridge elements define a space for alignment with conductor receiving portions of one of said conductive wire-formed connector elements which is adapted to be housed in the block.

11. A block as in claim 2 including:

fanning strips on the sides of said main body section;

said fanning strips defining passages in alignment with spaced rows between rows of said bridges for entry of electrical conductors.

12. A block as in claim 2 wherein:

each of said slots in said main body section is dimensioned to restrain one of said electrically conductive wire-formed connector elements from lateral movement.

13. A block as in claim 3 wherein said bridge elements are aligned in rows and wherein the passages in the bridge elements at the opposite ends of each row are in the form of U-shaped slots, the wire-formed connector elements being adapted to engage the bottoms of said U-shaped slots.

14. A block as in claim 1 wherein:

said releasable joining means includes locking arms extending from both first and second surfaces of said retainer section, and locking surfaces on said main body sections for locking engagement with said locking arms.

15. A block as in claim 1 further including:

a recess in said main body units, said recess communicating and aligned with said aperture upon releasably joining said connecting retainer to said main body units, said recess capable of supporting said pin means.

16. A block as in claim 15 wherein said pin means comprises:

a rectangular head portion, said head portion communicating with said recess after a frictional fit through said aperture; and a rod-shaped base attached to said head portion.

* * * * *